US008425349B2

(12) United States Patent
Dawson et al.

(10) Patent No.: US 8,425,349 B2
(45) Date of Patent: Apr. 23, 2013

(54) MULTIPLE MATERIAL GOLF CLUB HEAD AND A METHOD FOR FORMING A GOLF CLUB HEAD

(75) Inventors: Patrick Dawson, San Diego, CA (US); J. Andrew Galloway, Escondido, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 350 days.

(21) Appl. No.: 12/876,397

(22) Filed: Sep. 7, 2010

(65) Prior Publication Data

US 2011/0065528 A1 Mar. 17, 2011

Related U.S. Application Data

(60) Provisional application No. 61/242,469, filed on Sep. 15, 2009.

(51) Int. Cl.
*A63B 53/04* (2006.01)

(52) U.S. Cl.
USPC ..... 473/345; 473/348; 473/349

(58) Field of Classification Search ..... 473/324–350
See application file for complete search history.

(56) References Cited

U.S. PATENT DOCUMENTS 1,167,387 A 1/1916 Daniel
1,638,916 A 8/1927 Butchart
1,780,625 A 11/1930 Mattern
1,854,548 A 4/1932 Hunt
1,972,091 A 9/1934 Glover
2,750,194 A 6/1956 Clark
3,556,532 A 1/1971 Ballmer
3,814,437 A 6/1974 Winquist
3,815,921 A * 6/1974 Turner ..... 473/328
3,858,886 A 1/1975 Cosby
3,897,066 A 7/1975 Belmont
3,937,474 A 2/1976 Jepson et al.
3,941,390 A 3/1976 Hussey
3,975,023 A 8/1976 Inamori
3,989,248 A 11/1976 Campau
4,021,047 A 5/1977 Mader
4,213,613 A 7/1980 Nygren
4,214,754 A 7/1980 Zebelean
4,398,965 A 8/1983 Campau
4,432,549 A 2/1984 Zebelean
4,465,221 A * 8/1984 Schmidt ..... 228/125
4,489,945 A 12/1984 Kobayashi
4,511,145 A 4/1985 Schmidt
4,568,088 A 2/1986 Kurahashi
4,575,447 A 3/1986 Hariguchi
4,687,205 A 8/1987 Tominaga et al.
4,872,685 A 10/1989 Sun
4,877,249 A 10/1989 Thompson
4,957,294 A 9/1990 Long
5,028,049 A 7/1991 McKeighen (Continued)

*Primary Examiner* — Alvin Hunter
(74) *Attorney, Agent, or Firm* — Michael A. Catania; Rebecca Hanovice; Sonia Lari

(57) ABSTRACT

A method for forming a golf club head having a volume of approximately 460 cubic centimeters, the method comprising the steps of casting a face component, attaching a bonding flange, stamping a metal sheet of titanium alloy to form a sole component, welding the sole component to the face component to create a golf club head subassembly having a weld line of approximately six inches and polishing the weld line.

7 Claims, 8 Drawing Sheets

U.S. PATENT DOCUMENTS 5,060,951 A 10/1991 Allen
5,064,197 A 11/1991 Eddy
5,074,563 A 12/1991 Gorman
5,106,094 A * 4/1992 Desbiolles et al. ..... 473/342
5,172,913 A 12/1992 Bouquet
5,193,811 A 3/1993 Okumoto et al.
5,232,224 A * 8/1993 Zeider ..... 473/345
5,261,663 A 11/1993 Anderson
5,261,664 A 11/1993 Anderson
5,272,802 A 12/1993 Stites, III
5,280,911 A 1/1994 Katayama
5,282,624 A 2/1994 Viste
5,288,344 A 2/1994 Peker et al.
5,292,129 A 3/1994 Long et al.
5,333,872 A 8/1994 Manning et al.
5,344,140 A 9/1994 Anderson
5,346,216 A 9/1994 Aizawa
5,346,217 A 9/1994 Tsuchiya et al.
5,362,047 A 11/1994 Shaw et al.
5,362,055 A 11/1994 Rennie
5,377,985 A 1/1995 Ohnishi
5,377,986 A 1/1995 Viollaz et al.
5,398,935 A 3/1995 Katayama
5,405,136 A 4/1995 Hardman
5,405,137 A 4/1995 Vincent et al.
5,407,202 A 4/1995 Igarashi
RE34,925 E 5/1995 McKeighen
5,410,798 A 5/1995 Lo
5,411,255 A 5/1995 Kurashima et al.
5,417,419 A 5/1995 Anderson et al.
5,419,559 A 5/1995 Melanson et al.
5,425,538 A 6/1995 Vincent et al.
5,429,357 A 7/1995 Kobayashi
5,429,365 A 7/1995 McKeighen
5,447,307 A 9/1995 Antonious
5,451,056 A 9/1995 Manning
5,460,371 A 10/1995 Takeda
5,464,210 A 11/1995 Davis et al.
5,464,216 A 11/1995 Hoshi et al.
5,464,217 A 11/1995 Shenoha et al.
5,474,296 A 12/1995 Schmidt
5,482,279 A 1/1996 Antonious
5,485,998 A 1/1996 Kobayashi
5,489,094 A 2/1996 Pritchett
5,494,281 A 2/1996 Chen
5,499,814 A 3/1996 Lu
5,501,459 A 3/1996 Endo
5,505,453 A 4/1996 Mack
5,509,659 A * 4/1996 Igarashi ..... 473/345
5,516,107 A 5/1996 Okumoto et al.
5,527,034 A 6/1996 Ashcroft et al.
5,529,543 A 6/1996 Beaumont
5,547,194 A 8/1996 Aizawa et al.
5,547,427 A 8/1996 Rigal et al.
5,556,097 A 9/1996 Endo et al.
5,570,886 A 11/1996 Rigal et al.
5,601,501 A 2/1997 Kobayashi
5,611,742 A 3/1997 Kobayashi
5,618,359 A 4/1997 Lin et al.
5,624,331 A 4/1997 Lo et al.
5,628,698 A 5/1997 Sumitomo
5,676,605 A 10/1997 Kobayashi
5,711,363 A 1/1998 Scruggs et al.
5,711,722 A 1/1998 Miyajima
5,735,975 A 4/1998 Lin et al.
5,743,813 A 4/1998 Chen et al.
5,766,093 A 6/1998 Rohrer
5,776,011 A * 7/1998 Su et al. ..... 473/345
5,788,584 A 8/1998 Parente et al.
5,797,443 A 8/1998 Lin et al.
5,797,807 A 8/1998 Moore
5,830,084 A 11/1998 Kosmatka
5,836,830 A 11/1998 Onuki et al.
5,863,261 A 1/1999 Eggiman
5,888,148 A 3/1999 Allen
5,896,642 A 4/1999 Peker et al.
5,971,867 A 10/1999 Galy
5,971,868 A 10/1999 Kosmatka
6,007,432 A 12/1999 Kosmatka
6,021,840 A 2/2000 Colvin
6,048,278 A * 4/2000 Meyer et al. ..... 473/345
6,102,813 A * 8/2000 Dill ..... 473/305
6,123,627 A 9/2000 Antonious
6,146,571 A 11/2000 Vincent et al.
6,149,534 A 11/2000 Peters et al.
6,152,833 A 11/2000 Werner et al.
6,165,081 A 12/2000 Chou
6,280,349 B1 * 8/2001 Cook ..... 473/345
6,309,693 B1 10/2001 Wallace et al.
6,332,848 B1 12/2001 Long et al.
6,354,962 B1 3/2002 Galloway et al.
6,368,234 B1 4/2002 Galloway
6,386,990 B1 5/2002 Reyes et al.
6,390,933 B1 5/2002 Galloway et al.
6,398,666 B1 6/2002 Evans et al.
6,406,381 B2 6/2002 Murphy et al.
6,425,832 B2 7/2002 Cackett et al.
6,471,603 B1 10/2002 Kosmatka
6,471,604 B2 * 10/2002 Hocknell et al. ..... 473/334
6,565,452 B2 * 5/2003 Helmstetter et al. ..... 473/342
6,575,845 B2 * 6/2003 Smith et al. ..... 473/329
6,739,983 B2 * 5/2004 Helmstetter et al. ..... 473/342
6,875,126 B2 * 4/2005 Yabu ..... 473/305
6,969,326 B2 * 11/2005 De Shiell et al. ..... 473/345
7,025,692 B2 * 4/2006 Erickson et al. ..... 473/335
7,059,973 B2 * 6/2006 Erickson et al. ..... 473/345
7,066,835 B2 * 6/2006 Evans et al. ..... 473/346
7,121,955 B2 * 10/2006 Stevens et al. ..... 473/334
7,121,957 B2 * 10/2006 Hocknell et al. ..... 473/342
7,128,661 B2 * 10/2006 Soracco et al. ..... 473/329
7,163,470 B2 * 1/2007 Galloway et al. ..... 473/342
7,258,630 B2 * 8/2007 Erickson et al. ..... 473/345
7,396,291 B2 * 7/2008 Lo ..... 473/324
7,549,933 B2 * 6/2009 Kumamoto ..... 473/329
7,850,541 B2 * 12/2010 Meyer et al. ..... 473/314
8,062,151 B2 * 11/2011 Boyd et al. ..... 473/334
8,187,116 B2 * 5/2012 Boyd et al. ..... 473/329

* cited by examiner

Crown

Joint Closeup

MULTIPLE MATERIAL GOLF CLUB HEAD AND A METHOD FOR FORMING A GOLF CLUB HEAD

CROSS REFERENCES TO RELATED APPLICATIONS

The application claims priority to U.S. Provisional Patent Application No. 61/242,469 filed on Sep. 15, 2009.

STATEMENT REGARDING FEDERALLY SPONSORED RESEARCH OR DEVELOPMENT

Not Applicable

BACKGROUND OF THE INVENTION

1. Field of the Invention

The present invention relates to a method for forming a multiple material golf club head.

2. Description of the Related Art

The prior art discloses several methods for forming a golf club head.

One method is full casting which involves casting the entire golf club head, usually with a face pull tool. Duquette et al., U.S. Pat. No. 6,978,976 for a Magnetized Core With Pneumatic Release System For Creating A Wax Mold For A Golf Club Head describes certain aspects of the full casting method. Then a face insert is welded to the golf club head.

Another method is using a full casting method, using a face pull tool and then cutting a crown opening. A graphite crown is then bonded to cover the opening thereby forming a multiple material golf club head.

Yet another method is forming an entire golf club head from multiple pieces. In this method, several pieces (crown, sole, face and hosel) are welded together to form a precursor golf club head. Then, an opening is cut in the crown creating an opening. A graphite crown is then bonded to cover the opening thereby forming a multiple material golf club head.

Yet another method is a high performance multiple piece golf club head. This forming method involves making a multiple piece golf club head. The crown material needs to be of high quality expensive titanium so prior to welding the crown component to the sole component, the crown is chemically milled to the limits of drop tower durability. The chemical milling process is necessary to render the crown component to be competitive with graphite strength to weight ratio.

The tack facecup to sole (called face subassembly). Manually trim and tack crown to face subassembly. Fully weld face, crown, and sole (21 inches of weld). Grind weld and polish head.

Each of these prior art methods have drawbacks. Both multiple piece graphite crown and full casting require the manufacturer to produce a complete golf club head. The crown opening is then cut and replaced with a graphite crown. This is obviously wasteful because of the need to fabricate an entire golf club head and then removing a portion. The high performance multiple piece golf club head remedies this wastefulness by utilizing an expensive titanium material and which adds more cost to render the crown component weight competitive to graphite crowns.

BRIEF SUMMARY OF THE INVENTION

The present invention seeks to reduce the waste from current blacktop manufacturing methods while achieving similar or better performance than the high performance multiple piece golf club heads at a price point that is similar to conventional multiple piece golf club heads.

The process includes a face component and a stamped metal sole component preferably welded together without a crown component. The face component and the sole component are preferably welded together with a high tolerance. The face components and sole components are preferably manufactured past "desired points" and trimmed back to match 'net' CAD designs. The face component and the sole component weld line is then polished. This weld line is approximately six inches in length for a 460 cubic centimeter volume driver-type golf club head. In prior art multiple piece golf club head construction methods the weld line is typically twenty-one inches in length or more for a 460 cubic centimeter volume driver-type golf club head.

Thus, the present invention results in a significant reduction in finishing costs. More specifically, the finishing process for weld polishing requires expensive polishing belts. There are approximately five different belts ranging from very coarse to very fine. Each belt can usually polish around four to five golf club heads.

In the process of the present invention a crown is bonded into the golf club head subassembly.

The resulting weight of the crown in carbon composite ranges from 15 grams to 35 grams, more preferably from 20 grams to 30 grams and is most preferably 24 grams. The weight of the crown in the high performance multi-piece of the prior art is approximately 31 grams. By using the method of construction of the present invention, a manufacturer is obtains at least an additional seven grams of discretionary weight that can be used in other sections of the golf club head to improve mass properties such as moment of inertias (Izz, Iyy and Izz) through the center of gravity of the golf club head, durability (thicker face regions o other regions open to stress during loading), and lower or positioning of the center of gravity by shifting the mass of the golf club head.

The process includes welding the face component to the sole component to create a golf club head subassembly. This comprises only six inches of welding as opposed to the prior art twenty-one inches of welding. The golf club head subassembly is ground and polished, specifically the six inches of weld. The crown component is glued to the golf club head subassembly to create an unfinished golf club head. The unfinished golf club head is cleaned and finished.

This present invention is unique from other composite crown golf club heads or high performance multi-piece construction golf club heads because material is not wasted beyond what is necessary to form the golf club head. In traditional composite crown golf club heads, the whole golf club head is formed (either by casting or welding) and then an opening is cut from this whole golf club head for the composite crown. In the high performance multi-piece construction golf club heads, the crown component material is very expensive relative to conventional stamped or cast materials, and this high performance multi-piece construction golf club head crown component material needs to be chemically milled to achieve its performance. The cutting and chemical milling wastes material and adds cost to achieve performance. The method of the present invention achieves the same performance without adding additional costs.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The process preferably includes the manufacture of a cast face component and a stamped metal sole component. The face component and the sole component are assembled together in a welding fixture. The welding fixture locates on the inside of the face component and inside of the sole component. The welding fixture also locates on some sections of the outside surfaces of the face component and the sole component. The crown component is preferably formed from a carbon composite. Once the face component and sole component are welded into a golf club head subassembly, the golf club head subassembly is polished and prepared for adhesive bonding. The composite crown is bonded to the golf club head subassembly using an adhesive. After the adhesive cures, the unfinished golf club head is cleaned and finished (typically painting).

Preferably the face component is cast from titanium 6-4 alloy. The face component has a separate bonding flange attached along the top of the face component extending about 0.200 inch below the OML parting line. The separate bonding flange is preferably composed of the same or substantially similar material. Alternatively, the bonding flange is composed of a material that is adhesively attached to the face component and such materials include pre-preg materials, polymer materials, aluminum alloys, magnesium alloys and other like materials. Preferably the sole component is a stamped titanium alloy. The thickness of the sheet material for the sole component is determined by performance needs and manufacturability. The sole component is trimmed. Preferably the crown component is formed by compression molding a sheet molding compound. The crown component has a bonding flange between itself and the sole. Because of this design feature, the compression molded manufacturing technique is a preferred manufacturing technique. Alternative forming techniques include continuous fiber laminate construction and plastic injection molding.

As shown in FIGS. 1-8, a golf club head is composed of a face component with a bonding flange, a sole component and a crown component with a bonding flange in order to construct the golf club head according to a method of the present invention.

Figure 1:
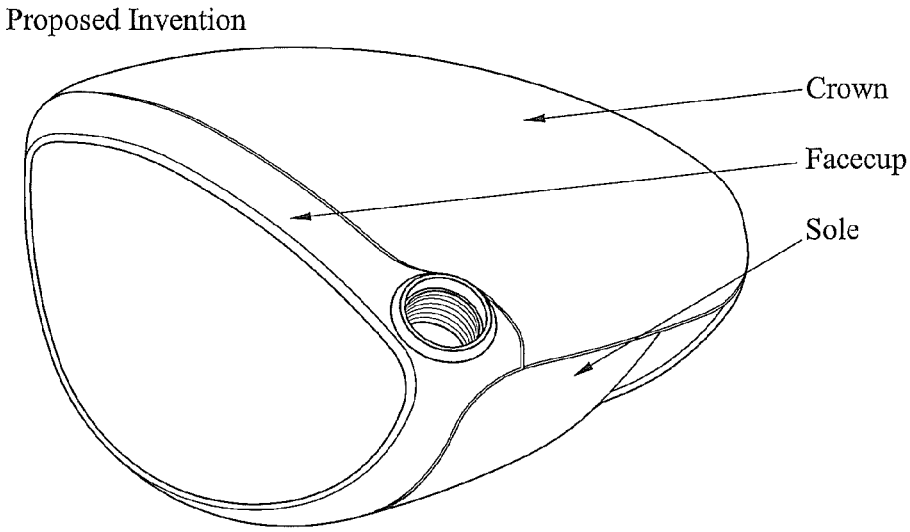
FIG. 1 is a perspective view of an unfinished golf club head.
Figure 2:
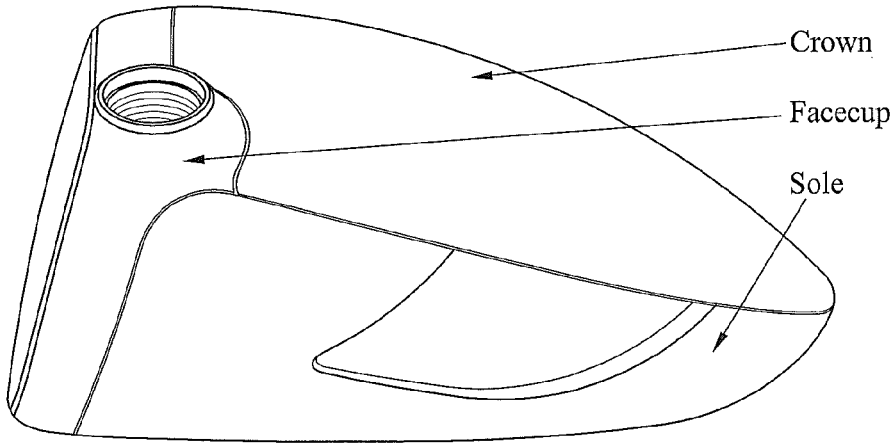
FIG. 2 is a side view of an unfinished golf club head.
Figure 3:
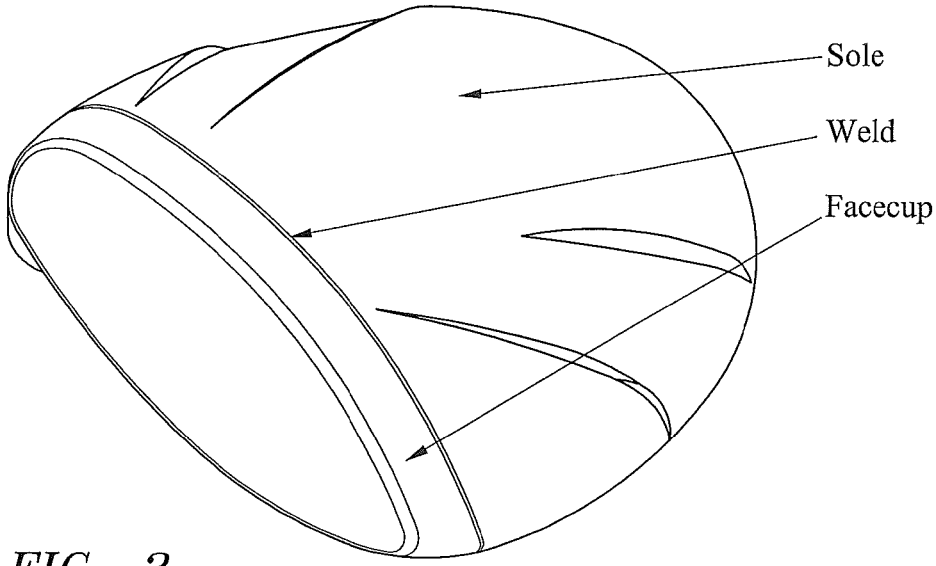
FIG. 3 is a bottom perspective view of an unfinished golf club head illustrating the weld line to be polished.
Figure 4:
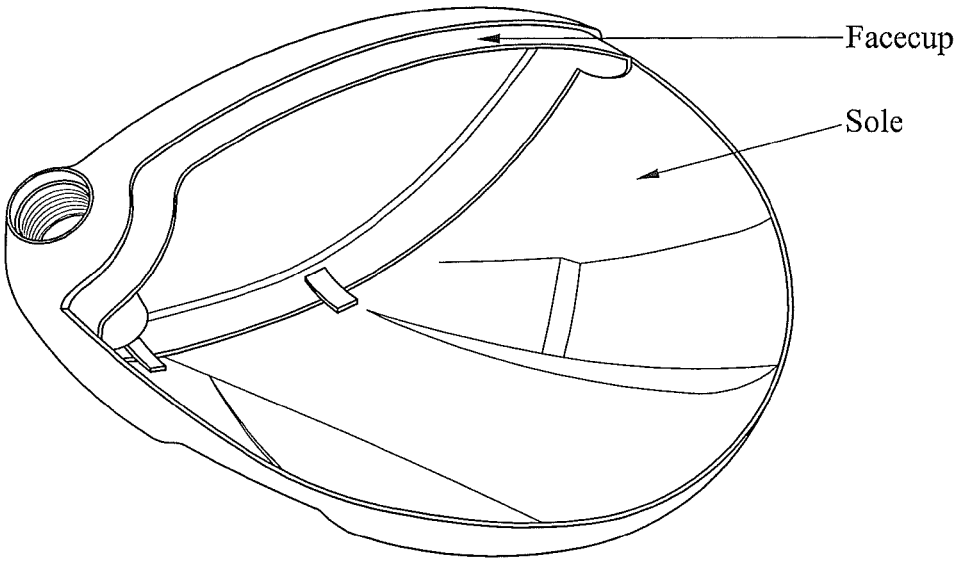
FIG. 4 is an isolated top perspective view of an interior of a subassembly of a golf club head to illustrate the bonding flange of a face component.
Figure 5:
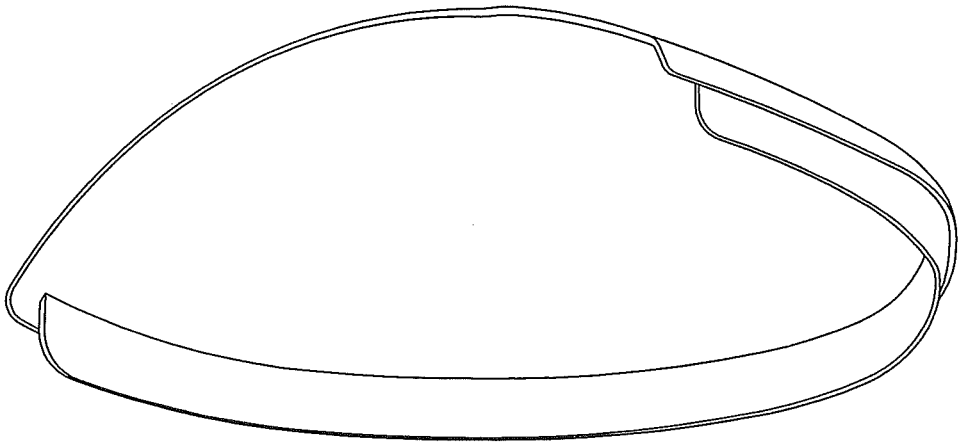
FIG. 5 is an isolated front perspective view of a crown component of a golf club head illustrating the bonding flange of the crown component.
Figure 6:
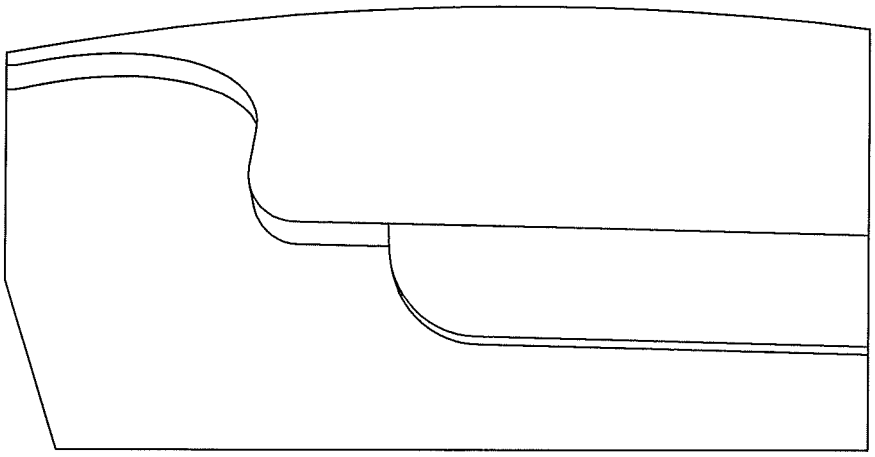
FIG. 6 is an enlarged isolated view of a crown component of FIG. 5 illustrating the bonding flange and joint for bonding with the subassembly.
Figure 7:
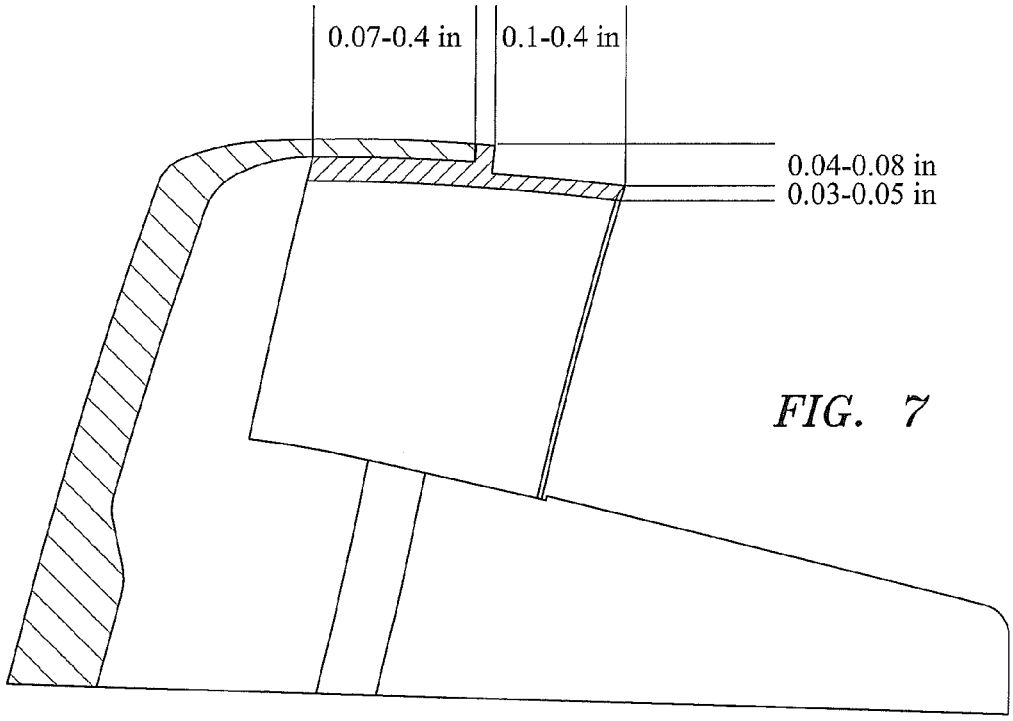
FIG. 7 is a cross-sectional view of a bonding joint of a golf club head illustrating a bonding flange of the face component and the crown component.
Figure 8:
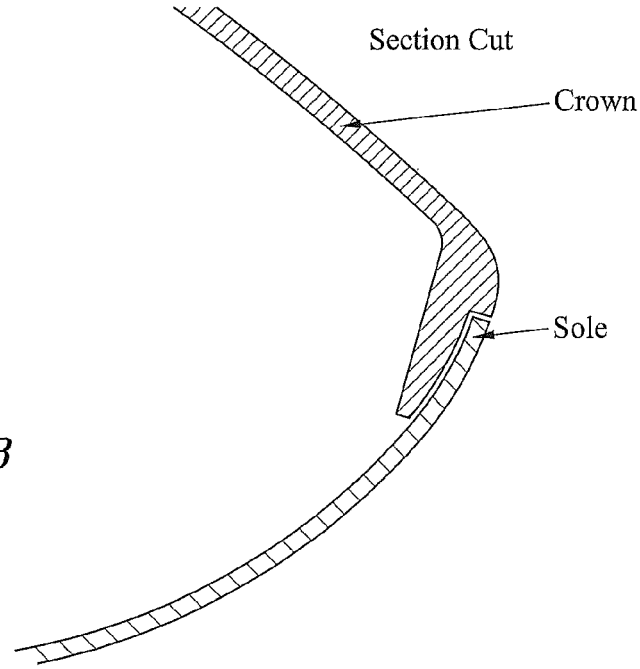
FIG. 8 is a cross-sectional view of a bonding joint of a golf club head illustrating a bonding flange of a crown component and a sole component.
Figure 9:
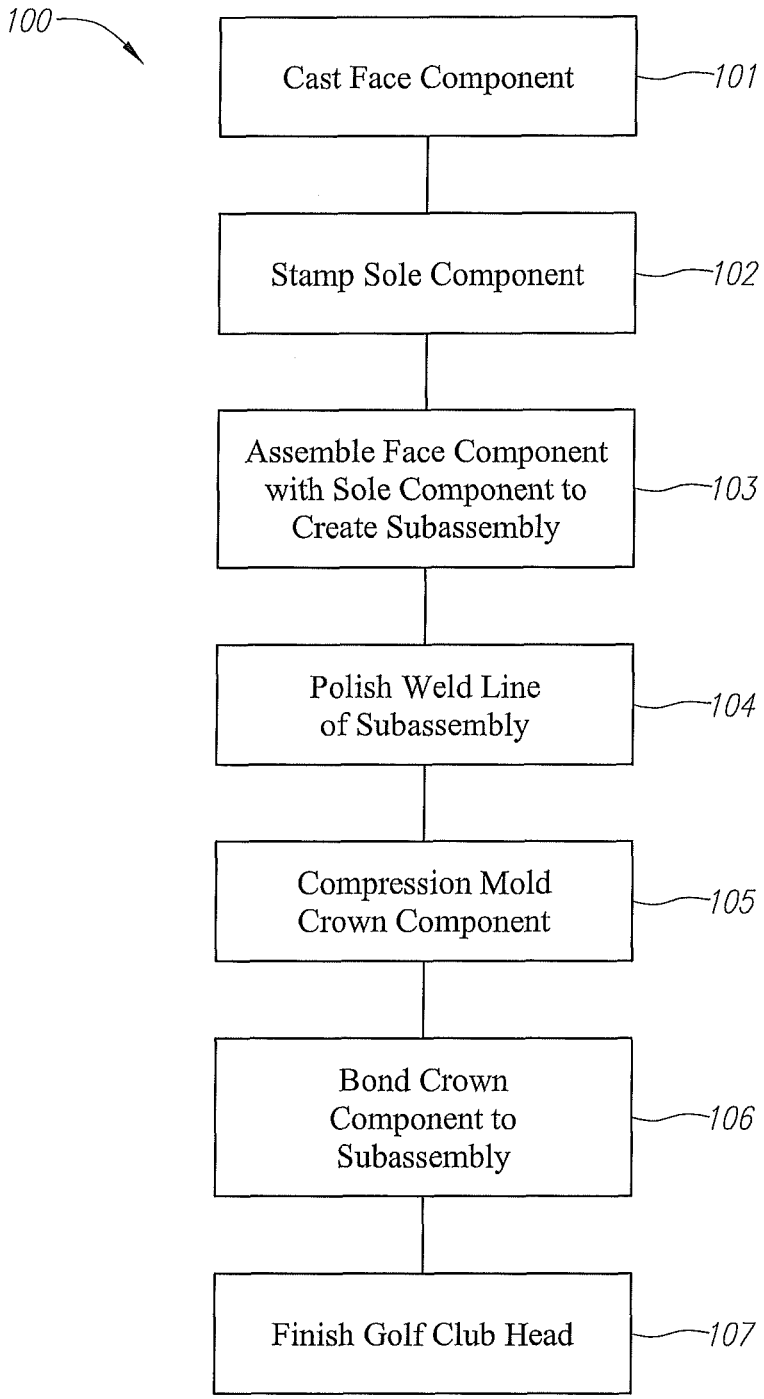
FIG. 9 is a flow chart of the method of the present invention.
Figure 10:
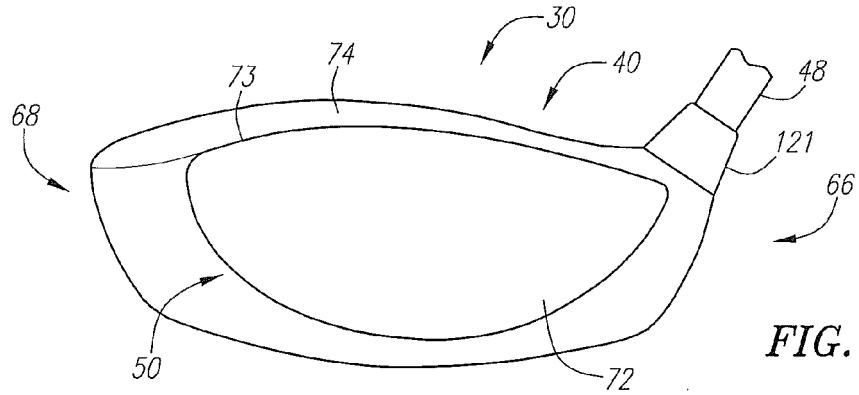
FIG. 10 is a front view of a fairway wood-type golf club head.

A preferred method of the present invention is illustrated in FIG. 9 and generally designated 100. At block 101, a face component is cast and a bonding flange is attached to a return portion of the face component. At block 102, a sole component is stamped from metal, preferably titanium. At block 103, the face component and sole component are assembled, preferably through welding, into a subassembly. At block 104, the weld line of the subassembly is polished. At block 105, a crown component is compression molded from a graphite compound. At block 106, the crown component is adhesively bonded to the subassembly. At block 107, the golf club head is finished.

As shown in FIGS. 10-17A, a fairway-type golf club is generally designated 30. The golf club 30 has a golf club head 40 with a hollow interior, not shown. Engaging the club head 40 is a shaft 48 that has a grip, not shown, at a butt end and is inserted into a hosel 54 at a tip end.

The club head 40 is generally composed of two components, a major body 50 and minor body 60. The minor body 60 has a crown section 62 and a ribbon section 64. The club head 40 may also be partitioned into a heel end 66 nearest the shaft 48, a toe end 68 opposite the heel section 66, and an aft end 70.

The major body 50 is generally composed of a single piece of metal, and is preferably composed of a cast metal material. More preferably, the cast metal material is a stainless steel material or a titanium material such as pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Alternatively, the major body may be manufactured through forging, welding, forming, machining, powdered metal forming, metal-injection-molding, electro-chemical milling, and the like.

The major body 50 generally includes a striking plate section (also referred to herein as a face plate) 72, a return section 74 extending laterally rearward from the upper perimeter of the striking plate section 72, a sole section 76 extending laterally rearward from the striking plate section 72, a ribbon section 78 extending upward from the sole section 76, and a ledge section 80 stepped inward for attachment of the minor body 60. The striking plate section 72 typically has a plurality of scorelines thereon.

The return section 74 extends inward, towards the minor body 60, and has a general curvature from the heel end 66 to the toe end 68. The return section 74 has a length from the perimeter 73 of the striking plate section 72 that is preferably a minimal length near the center of the striking plate section 72, and increases toward the toe end 68 and the heel end 66. A distance d represents the length of the return section 74 from the perimeter 73 at the center of the striking plate section 72, a distance d' from the perimeter 73 at the heel end 66 of the striking plate section 72, and a distance d" from the perimeter 73 at the toe end 68 of the striking plate section 72. In a preferred embodiment, the distance d ranges from 0.2 inch to 1.0 inch, more preferably 0.30 inch to 0.75 inch, and most preferably 0.60 inch for a 3-wood golf club head 40 and 0.35 inch for an eleven wood golf club head 40, as measured from the perimeter 73 of the striking plate section 72 to the rearward edge of the return section 74. In a preferred embodiment, the distance d' ranges from 0.4 inch to 1.25 inch, more preferably 0.50 inch to 0.100 inch, and most preferably 0.8 inch, as measured from the perimeter 73 of the striking plate section 72 to the rearward edge of the return section 74. In a preferred embodiment, the distance d" ranges from 0.4 inch to 1.25 inch, more preferably 0.50 inch to 0.100 inch, and most preferably 0.9 inch, as measured from the perimeter 73 of the striking plate section 72 to the rearward edge of the return section 74. The perimeter 73 of the striking plate section 72 is defined as the transition point where the major body 50 transitions from a plane substantially parallel to the striking plate section 72 to a plane substantially perpendicular to the striking plate section 72. Alternatively, one method for determining the transition point is to take a plane parallel to the striking plate section 72 and a plane perpendicular to the striking plate section 72, and then take a plane at an angle of forty-five degrees to the parallel plane and the perpendicular plane. Where the forty-five degrees plane contacts the major body 50 is the transition point thereby defining the perimeter 73 of the striking plate section 72.

The minor body 60 is preferably composed of a non-metal material, preferably a composite material such as continuous fiber pre-preg material (either thermosetting resin or thermoplastic resin). Other materials for the minor body 60 include other thermosetting materials or other thermoplastic materials such as injection molded plastics. The minor body 60 is preferably manufactured through bladder-molding, resin transfer molding, resin infusion, injection molding, compression molding, or a similar process. In a preferred process, the major body 50, with an adhesive on the exterior surface of the ledge section 80, is press-fitted with the minor body 60. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Figure 17A:
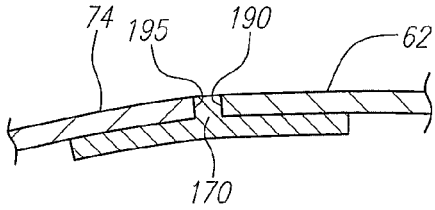
FIG. 17A is an isolated view of circle A of FIG. 17.
Figure 17:
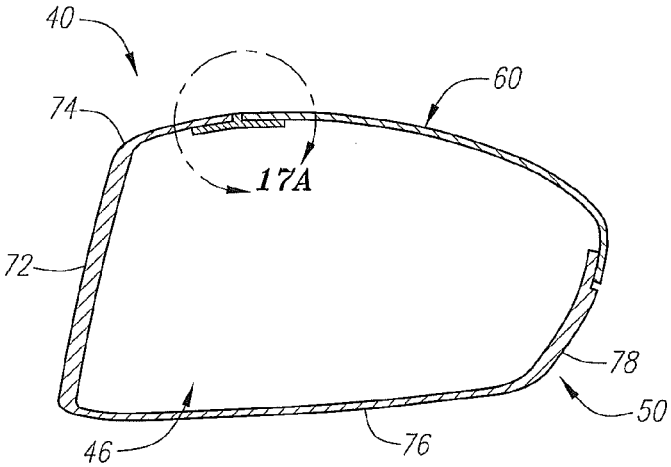
FIG. 17 is a cross-sectional view along line 8-8 of FIG. 16.

As shown specifically in FIG. 17A a separate bonding flange is utilized to connect the minor body to the major body. The crown section 62 of the minor body 60 is generally convex toward the sole section 76, and transitions into the ribbon section 64. The crown section 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The ribbon section 64 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

In a preferred embodiment, the minor body 60 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The sole section 76 of the major body 50 is generally convex toward the crown section 62. The sole section 76 alternatively has a recess for attachment of a sole plate thereto. The sole plate is preferably attached with a pressure sensitive adhesive such as a polyethylene foam acrylic adhesive sold by the 3M company. The sole plate is preferably composed of a light weight metal such as aluminum, titanium or titanium alloy. Alternatively, the sole plate is composed of a durable plastic material. The sole plate may have graphics thereon for designation of the brand of club and loft.

Preferably, the major body 50 is cast from molten metal in a method such as the well-known lost-wax casting method. The metal for casting is preferably 17-4 stainless steel. Additional methods for manufacturing the major body 50 include forming the major body 50 from a flat sheet of metal, superplastic forming the major body 50 from a flat sheet of metal, machining the major body 50 from a solid block of metal, electrochemical milling the major body 50 from a forged pre-form, and like manufacturing methods. Yet further methods include diffusion bonding titanium or steel sheets to yield a variable face thickness face and then superplastic forming.

The present invention is directed at a golf club head that has a high coefficient of restitution thereby enabling for greater distance of a golf ball hit with the golf club head of the present invention.

The mass of the club head 40 of the present invention ranges from 165 grams to 250 grams, preferably ranges from 175 grams to 230 grams, and most preferably from 200 grams to 221 grams, with the three-wood golf club head 40 preferably having a mass of 203 grams and the eleven-wood golf club head 40 preferably having a mass of 221 grams. Preferably, the major body 50 has a mass ranging from 140 grams to 200 grams, more preferably ranging from 150 grams to 180 grams, yet more preferably from 155 grams to 166 grams, and most preferably 161 grams. The minor body 60 has a mass preferably ranging from 4 grams to 20 grams, more preferably from 5 grams to 15 grams, and most preferably 7 grams. The rear weighting member 122 has a mass preferably ranging from 10 grams to 50 grams, more preferably from 30 grams to 40 grams, and most preferably 31 grams. The heel weighting member 123 has a mass preferably ranging from 2 grams to 15 grams, more preferably from 3 grams to 10 grams, and most preferably 5 grams. Additionally, epoxy, or other like flowable materials, in an amount ranging from 0.5 grams to 5 grams, may be injected into the hollow interior 46 of the golf club head 40 for selective weighting thereof.

The axes of inertia are designated X, Y and Z. The X axis extends from the striking plate section 72 through the center of gravity, CG, and to the rear of the golf club head 40. The Y axis extends from the toe end 68 of the golf club head 40 through the center of gravity, CG, and to the heel end 66 of the golf club head 40. The Z axis extends from the crown section 62 through the center of gravity, CG, and to the sole section 76.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

Figure 11:
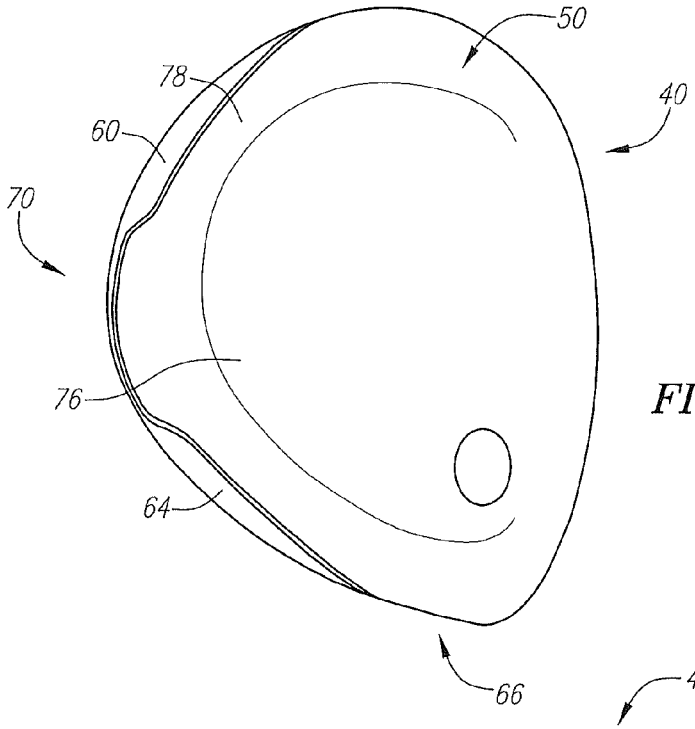
FIG. 11 is a bottom view of the golf club head of FIG. 10.
Figure 12:
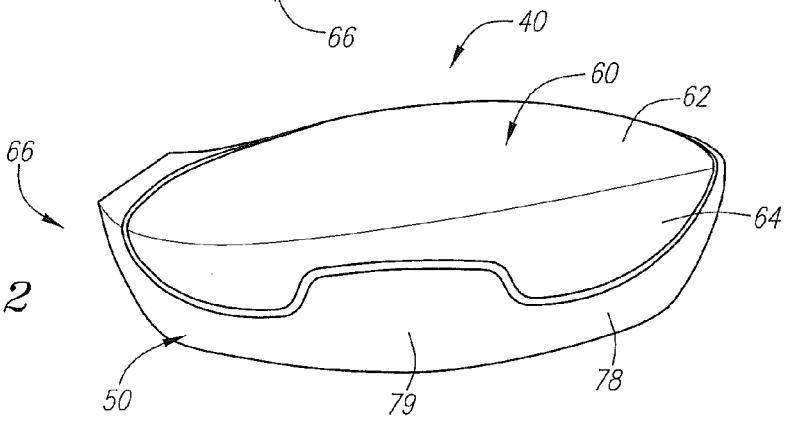
FIG. 12 is rear side view of the golf club head of FIG. 10.
Figure 13:
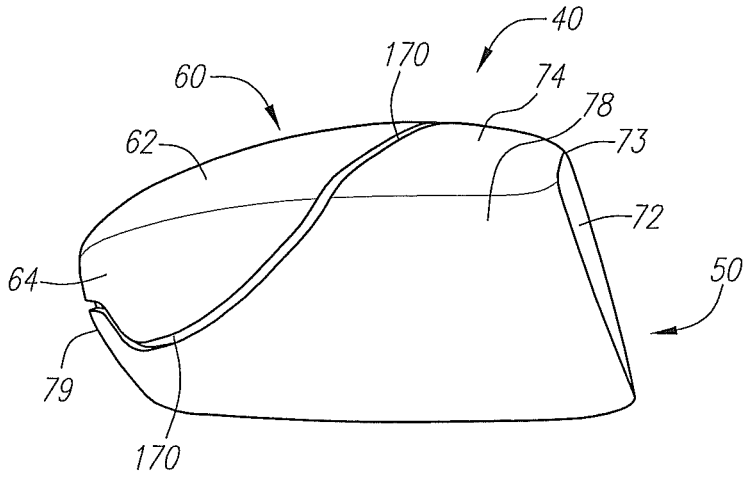
FIG. 13 is a toe side plan view of the golf club head of FIG. 10.
Figure 14:
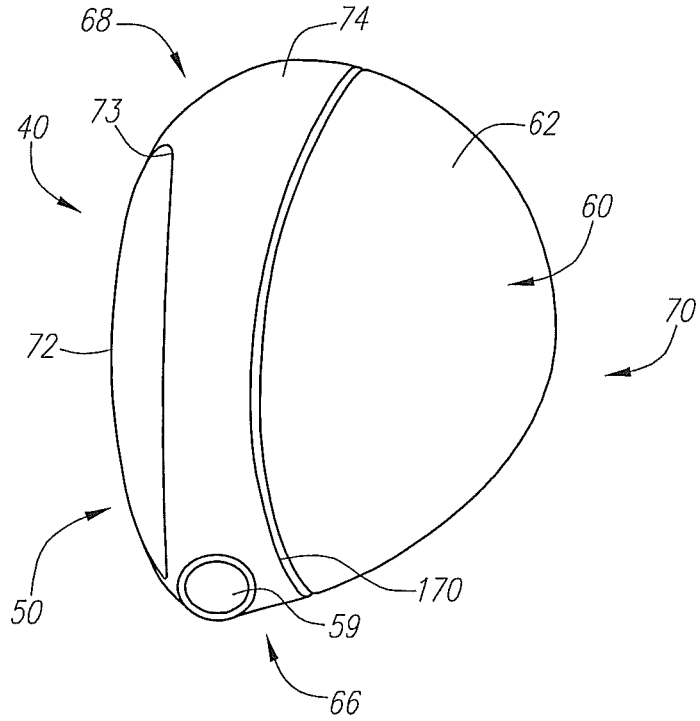
FIG. 14 is a top plan view of the golf club head of FIG. 10.
Figure 15:
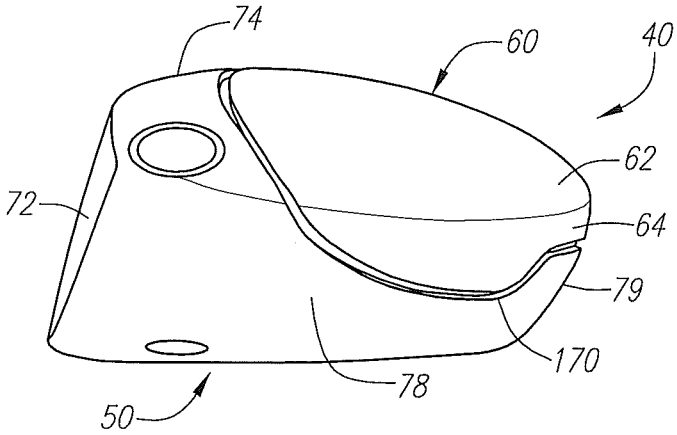
FIG. 15 is a heel side view of the golf club head of FIG. 10.
Figure 16:
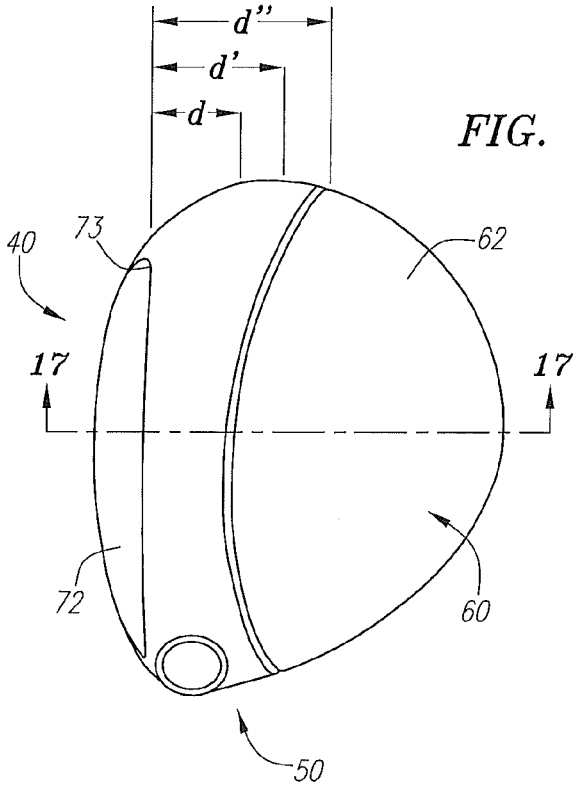
FIG. 16 is a top plan view of the golf club head of FIG. 10.

The center of gravity and the moment of inertia of a golf club head 40 are preferably measured using a test frame ($X^T$, $Y^T$, $Z^T$), and then transformed to a head frame ($X^H$, $Y^H$, $Z^H$), as shown in FIGS. 11 and 11A. The center of gravity of a golf club head may be obtained using a center of gravity table having two weight scales thereon, as disclosed in co-pending U.S. patent application Ser. No. 09/796,951, filed on Feb. 27, 2001, entitled High Moment Of Inertia Composite Golf Club, and hereby incorporated by reference in its entirety.

In general, the moment of inertia, Izz, about the Z axis for the golf club head 40 of the present invention will range from 1900 g-cm$^2$ to 3000 g-cm$^2$, preferably from 1990 g-cm$^2$ to 2500 g-cm$^2$, and most preferably from 1990 g-cm$^2$ to 2400 g-cm$^2$. The moment of inertia, Iyy, about the Y axis for the golf club head 42 of the present invention will range from 900 g-cm$^2$ to 1700 g-cm$^2$, preferably from 950 g-cm$^2$ to 1500 g-cm$^2$, and most preferably from 965 g-cm$^2$ to 1200 g-cm$^2$. Table One list the moments of inertia for a 3-wood golf club head 40, a 7-wood golf club head 40, 9-wood golf club head 40 and 11-wood golf club head 40.

TABLE ONE

| Club | Ixx | Iyy | Izz |
|---|---|---|---|
| 3 wood | 1937 | 1110 | 2392 |
| 7 wood | 1561 | 965 | 1995 |
| 9 wood | 1577 | 991 | 2034 |
| 11 wood | 1579 | 1001 | 2049 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for forming a golf club head, the method comprising:

casting a face component, the face component comprising a striking plate section and a return section;

welding a bonding flange to the return section of the face component;

stamping a metal sheet to form a sole component;

welding the sole component to the face component to create a golf club head subassembly having a weld line;

polishing the weld line;

compression molding a crown component from a non-metal compound, the crown component having a bonding flange;

bonding the crown component to the golf club head subassembly using an adhesive to create an unfinished golf club head; and finishing the unfinished golf club head to create a golf club head.

2. The method according to claim 1 wherein the bonding flange is composed of a titanium alloy material.

3. The method according to claim 1 wherein the bonding flange is composed of a stainless steel material.

4. The method according to claim 1 wherein the bonding flange is composed of an aluminum alloy material.

5. The method according to claim 1 wherein the bonding flange is composed of a magnesium alloy material.

6. The method according to claim 1 wherein the face component and the bonding flange are composed of a titanium alloy material.

7. The method according to claim 1 wherein the face component and the bonding flange are composed of a stainless steel material.

* * * * *